US005742469A

United States Patent [19]

Hamm

[11] Patent Number: 5,742,469

[45] Date of Patent: Apr. 21, 1998

[54] FENCE ELECTRIFYING DEVICE

[76] Inventor: Valery Hamm, Les Pelouses, Route du Lude, 72200 La Fleche, France

[21] Appl. No.: 621,968

[22] Filed: Mar. 26, 1996

[30] Foreign Application Priority Data

Mar. 31, 1995 [FR] France ..... 95 03798

[51] Int. Cl.[6] ..... H01T 23/00

[52] U.S. Cl. ..... 361/230; 361/225

[58] Field of Search ..... 361/230, 232, 361/225, 233; 307/109, 110, 106, 108; 340/564

[56] References Cited

U.S. PATENT DOCUMENTS 4,114,185 9/1978 Gallagher ..... 361/232

FOREIGN PATENT DOCUMENTS 2087146 12/1971 France .
2 553 972 5/1985 France .
3 437 953 4/1986 Germany .
2 004 426 3/1979 United Kingdom .

*Primary Examiner*—Jeffrey A. Gaffin
*Assistant Examiner*—Sally C. Medley
*Attorney, Agent, or Firm*—Young & Thompson

[57] ABSTRACT

A fence electrifying device supplied with AC power with a triggering circuit 23 having an input 27 connected to the common point of the resistor 4 and diodes 3 and 6, and an input 25 connected to the input terminal 1. The triggering of the conductive state in the thyristor takes place when the first terminal 1 is in the vicinity of its most negative potential in relation to the potential of the second terminal 2.

7 Claims, 3 Drawing Sheets

FENCE ELECTRIFYING DEVICE

BACKGROUND OF THE INVENTION

1. Field of the Invention

The invention relates to fence electrifying devices supplied from an AC electrical power supply network and intended to keep animals in or to protect areas from intrusion by animals or people.

2. Description of the Prior Art

The devices available in the market usually comprise a voltage doubler with a diode used to charge a storage capacitor. This capacitor is discharged, after a period of approximately 1.2 s, into the primary of a transformer, by making one or more thyristors conductive. French patent No. 2,553,972 describes such a device. The thyristor are made conductive by applying a triggering pulse to the gate, usually with a phase at random in relation to the alternating voltage of the network supplying the electrifying device, and this is a drawback.

Indeed, when the thyristors are made conductive during the positive swing of the power supply, the diode of the voltage doubler is conductive and the capacitor dumping pulse is transmitted to the network which receives it as a disturb pulse.

SUMMARY OF THE INVENTION

One aim of the invention is to provide circuitry that avoids transmitting this disturb pulse to the network and without recourse to a filtering network.

The object of the invention is to provide a fence electrifying device supplied by an AC network between a first terminal and a second terminal. The AC network supplies a storage capacitor via a voltage doubler. The voltage doubler comprises, in series with the first terminal, a capacitor, a first resistor, a first diode and a second resistor. The voltage doubler comprises, in parallel between the second terminal and the point common to both the first resistor and the first diode, a second diode, the storage capacitor which can be dumped abruptly into the primary of a transformer of which the secondary supplies said fence, by means of a thyristor of which the gate is controlled by a triggering circuit. The triggering circuit comprises an input connected to the common point of the first resistor and the two diodes. The triggering of the conductive state in the thyristor takes place when the first terminal is in the vicinity of its most negative potential in relation to that of the second terminal, so as not to disturb the network with a disturb signal.

The thyristor triggering circuit may comprise a transistor of which the collector is connected to the gate of the thyristor. The thyristor's emitter would be connected to the mid-point of a circuit with a resistor and a capacitor. The thyristor's base would be connected to the input. In so doing, the transistor would be made conductive when the first terminal is in the vicinity of its most negative potential in relation to the potential of the second terminal.

The thyristor gate may be connected to the transistor collector via a bidirectional diode thyristor and a resistor;

The transistor base may be connected to said input of the triggering circuit via a Zener diode resistor and a diode;

The circuit with resistor and capacitor may be mounted between the first terminal and the second terminal;

Between the first terminal and the resistor there may be provided a diode to charge the capacitor during the positive swings of the power supply.

The circuit with resistor and capacitor may be mounted between the primary of the transformer and the second terminal.

DESCRIPTION OF THE PREFERRED EMBODIMENTS

Figure 1:
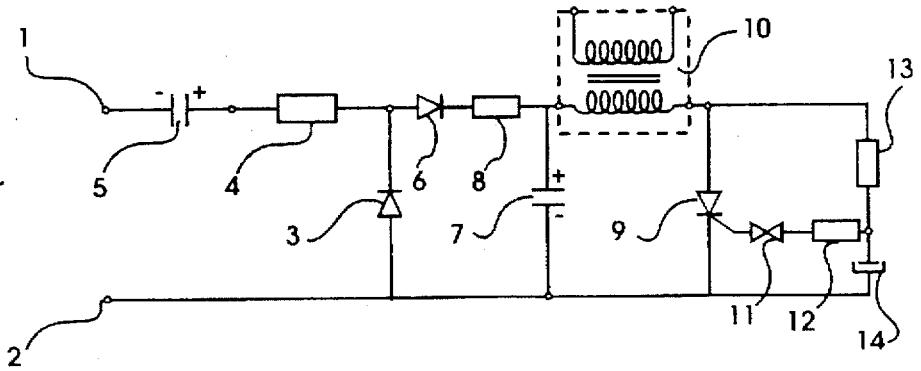
FIG.1 PRIOR ART
FIG. 1 represents an embodiment of a fence electrifying device in the state of the art.

FIG. 1 shows the circuit diagram of a commonplace type of fence electrifying device, supplied by an AC network. The alternating mains voltage is applied to the input terminals 1 and 2 of the circuitry. During the so-called negative swing, i.e. when the potential of terminal 1 is lower that the potential of terminal 2, the diode 3 is conductive. A current passes through the diode 3, the resistor 4 and the capacitor 5, charging the latter to the peak value of the alternating mains voltage with the polarity indicated in FIG. 1. During the so-called positive swing, i.e. when the potential of terminal 1 is greater than the potential of terminal 2, the diode 3 is shut off and the diode 6 is conductive. Part of the load in the capacitor 5 is transferred to the storage capacitor 7 via the resistor 4, the diode 6 and the resistor 8. The process continues until the capacitor 7 is charged, with the polarity indicated in FIG. 1, with a voltage equal to twice the peak value of the alternating mains voltage. When a main thyristor 9 becomes conductive, it abruptly dumps the capacitor 7 via the primary of a transformer 10. The triggering circuit, which generates the gate pulse in a known manner with a period of approximately 1.2 s, comprises a bidirectional diode thyristor 11, a resistor 12, another resistor 13 and a capacitor 14. This triggering circuit has the drawback of generating a gate pulse at random in relation to the phase of the alternating voltage applied between the terminals 1 and 2.

If this pulse arrives during the so-called positive swing, and in particular at an instant close to when the positive voltage is at its maximum, a pulsed current will pass through the capacitor 5, the resistor 4, the diode 6 and the resistor 8. The voltage at the terminals of the capacitor 7 cancels itself out quickly when the main thyristor 9 becomes conductive. The voltage at the common point between the capacitor 5 and the resistor 4 is equal to the sum of the voltage between the terminals 1 and 2 and the voltage at the terminals of the capacitor 5, which at that time is equal to twice the peak voltage of the AC supply network. As the voltage at the terminals 7 is nil, the resistor 4 - diode 6 - resistor 8 assembly is therefore subjected to a voltage equal to twice the peak voltage of the AC network, and therefore to a high-value pulsed current. The electrifying device manufacturer must then oversize the resistors 4 and 8 in order for them to dissipate the power due to this current. The pulsed current which passes through the capacitor 5, the resistor 4, the diode 6 and the resistor 8, also flows through the AC network connected to the terminals 1 and 2 which usually leads to a level of electromagnetic disturbance in excess of the limit imposed by standards. The manufacturer must then install a very costly filter in order to comply with these standards.

Figure 2:
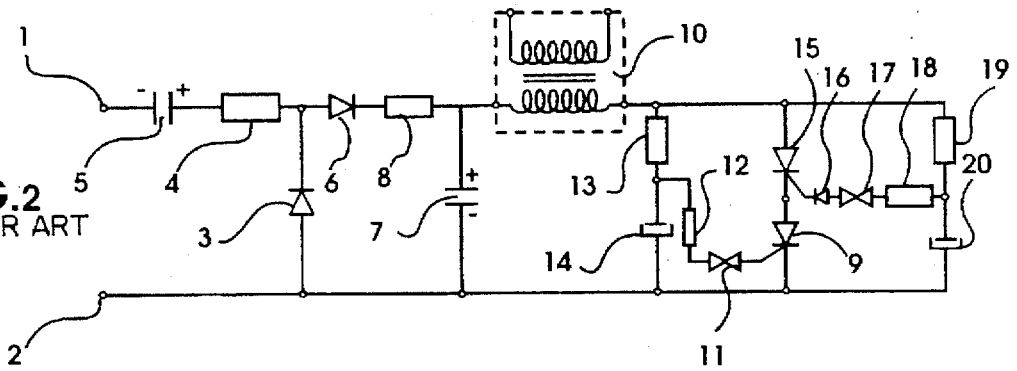
FIG.2 PRIOR ART
FIG. 2 represents a second embodiment of a fence electrifying device in the state of the art.

FIG. 2 shows the circuit diagram of a fence electrifying device equipped with a circuit for protection against frequency accelerations. This protective circuit, disclosed in French patent No. 2,553,972 comprises several additional elements in relation to the current circuit in FIG. 1, namely a thyristor 15, a diode 16, a bidirectional diode thyristor 17, a resistor 18, a resistor 19 and a capacitor 20. In order to be able to dump the capacitor 7, the two thyristors 9 and 15 must be conductive. Therefore, when the pulse arrives at the main thyristor 9 gate, the capacitor 20 must be charged to a sufficient level for the triggering of the thyristor 15 to take place simultaneously. This condition ensures that close triggerings of the main thyristor 9 do not lead to the creation of pulses at output of the transformer 10 at a high rate incompatible with safety.

Figure 3:
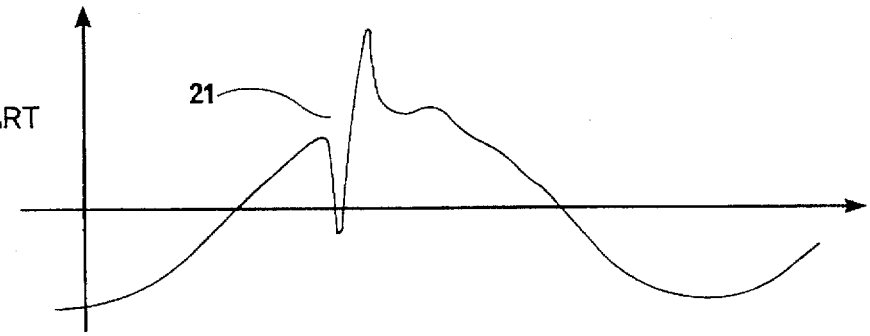
FIG.3 PRIOR ART
FIG. 3 represents the mains voltage of the electrifying device, disturbed by the dump pulse in the case of FIGS. 1 and 2.

In normal operation, the circuit in FIG. 2 has similar drawbacks to those encountered with the circuit in FIG. 1 since the pulse arriving at the gate of the main thyristor is also random in relation to the phase of the alternating voltage applied between the terminals 1 and 2. FIG. 3 shows the rate of the alternating voltage applied between the terminals 1 and 2 and shows the disturbance 21 occurring when the main thyristor 9 gate pulse arrives at the peak of the positive swing.

Figure 4:
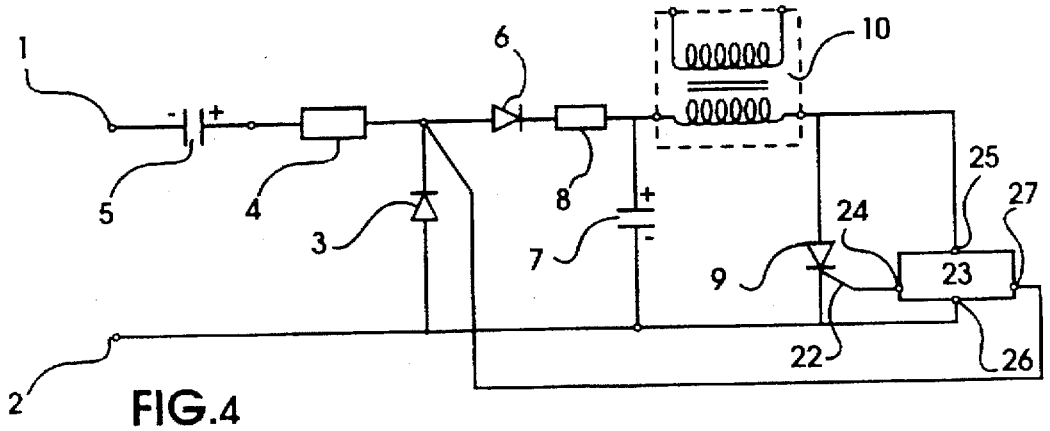
FIG. 4 schematically represents a fence electrifying device according to the invention.

The invention proposes to obviate the two drawbacks of the circuits in FIGS. 1 and 2 by appropriately setting the phase of the gate pulse in relation to the alternating voltage applied between the terminals 1 and 2. FIG. 4 shows the structure of a commonplace type of fence electrifying device comprising input terminals 1 and 2, a voltage doubler 3, 4, 5, 6, 8, a storage capacitor 7, an output transformer 10 and a main thyristor 9.

The gate 22 of the main thyristor 9 receives, from a triggering circuit 23 via an output 24, a pulse making the main thyristor 9 conductive, with a period of approximately 1.2 s. The operating power for the triggering circuit 23 is taken from the storage capacitor 7 via the transformer 10, via two inputs 25 and 26. The voltage at the common point between the resistor 4, the diode 3 and the diode 6 is applied to an input 27 of the triggering circuit 23. The latter uses the voltage at its input 27 to impose the occurrence, at its output 24, of a pulse making the main thyristor 9 conductive, at an instant close to the instant when the negative swing of the voltage between the terminals 1 and 2 reaches its minimum, i.e. at an instant close to the instant when the terminal 1 reaches its most negative potential in relation to the terminal 2.

In this case, at the time of the triggering of the main thyristor 9, the sum of the voltage between the terminals 1 and 2 and the voltage at the terminals of the capacitor 5 is nil. As the voltage at the terminals of the storage capacitor is nil, the resistor 4 - diode 6 - resistor 8 assembly is therefore subjected to a zero voltage. There is no longer any power dissipated in the resistors 4 and 8, and the disturbance disappears as there is no longer any pulsed current.

Figure 5:
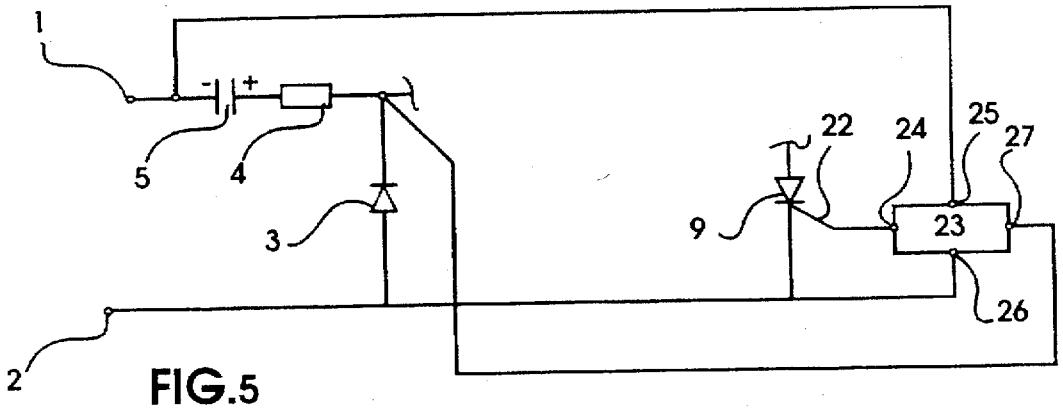
FIG. 5 schematically represents a partial view of another embodiment of the invention.

FIG. 5 partially shows the structure of a commonplace type of fence electrifying device. In this case, the circuit 23 triggering the main thyristor 9 takes its operating power directly from the inputs 1 and 2 of the electrifying device via two inputs 25 and 26.

Figure 6:
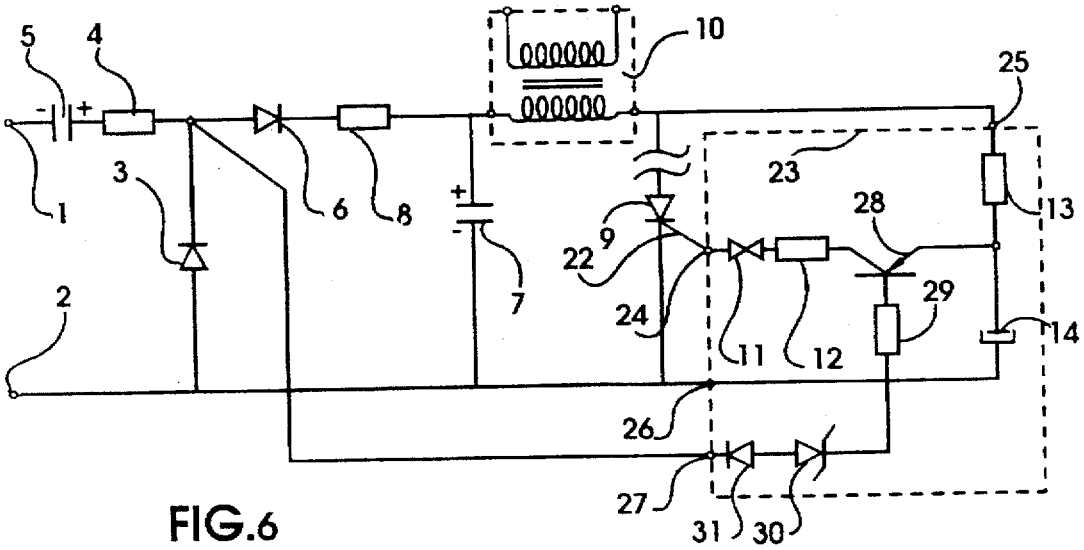
FIG. 6 shows a detailed view of a preferred embodiment of the invention.

FIG. 6 shows a diagram of the electrifying device with a detailed view of a preferred embodiment of the circuit 23 for triggering the main thyristor 9. This main thyristor 9 can be connected directly to the transformer 10 as in FIG. 1, or via an additional thyristor 15 as in FIG. 2, without the operation of the invention being modified. By means of the inputs 25 and 26 of the triggering circuit 23, the capacitor 14 is charged via the resistor 13 by taking energy from the storage capacitor 7 via the transformer 10. As long as the voltage at the terminals of the capacitor 14 is below the threshold voltage of the bidirectional diode thyristor 11, the charging of the capacitor 14 continues since no current can flow in the bidirectional diode thyristor 11, the resistor 12 and the PNP transistor 28. When the voltage at the outputs of 14 reach and exceed the threshold of the bidirectional diode thyristor 11, after approximately 1.2 s, a main thyristor 9 triggering pulse can appear at the output 24 towards the gate 22, provided the PNP type transistor 28 is conductive, and that a current therefore passes through its base. When the voltage at the common point of the resistor 4, diode 3, and diode 6 is close to zero, i.e. when the negative swing of the voltage applied between the terminals 1 and 2 is close to its negative maximum, the base/emitter junction of the PNP transistor 28 is conductive. The current flowing through this junction is set by the resistor 29 which is subjected to the voltage at the terminals of the capacitor 14 less the sum of the voltage at the terminals of the base/emitter junction of the transistor 28, plus the voltage at the terminals of the Zener diode 30 and the voltage at the terminals of the diode 31. The choice of the Zener diode 30 imposes that the transistor 28 only be made conductive around an instant corresponding to the negative maximum of the negative swing of the voltage applied between the terminals 1 and 2. The diode 31 protects the transistor 28 during the positive swings of the voltage applied between the terminals 1 and 2.

Figure 7:
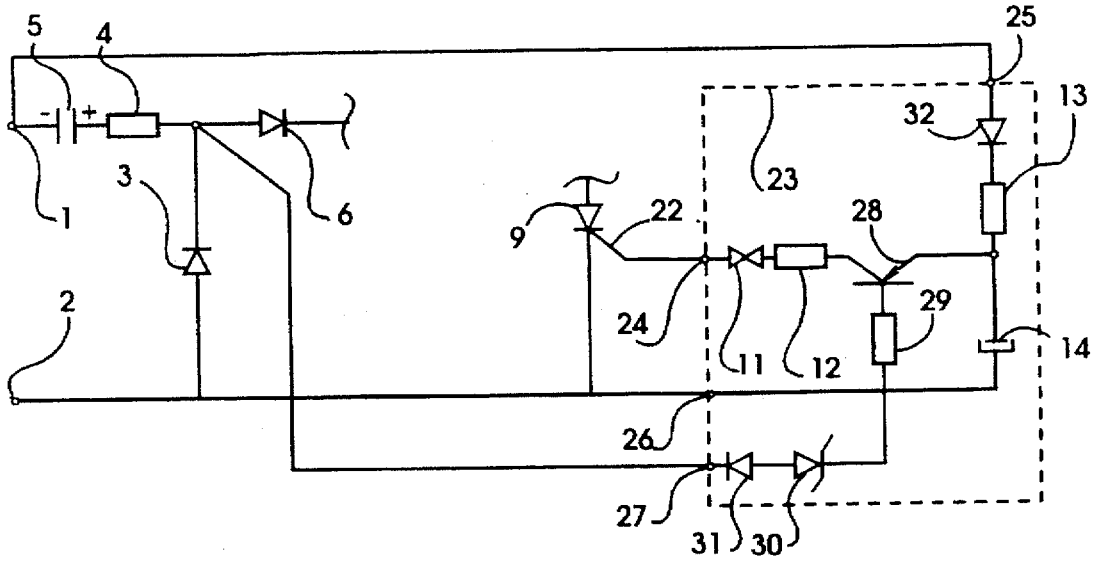
FIG. 7 shows a detailed view of another preferred embodiment of the invention.

FIG. 7 partially shows the diagram of an electrifying device with a detailed view of another preferred embodiment of the circuit. The point from which the power is taken is the only difference between the circuit in FIG. 6 and the circuit in FIG. 7. In FIG. 7, the power is taken from the terminal 1 via a diode 32, by way of the input 25 of the triggering circuit 23. In this case, the capacitor 14 can only be charged and have the voltage at its terminals increase during the positive swings of the voltage applied between the terminals 1 and 2. The temporal stability of the triggering is better in this instance than in the case of FIG. 6 since the voltage at the terminals of the capacitor 14 cannot change during the negative swings of the voltage applied between the terminals 1 and 2.

What is claimed is:

1. A fence electrifying device comprising a first terminal (1), a second terminal (2), said first terminal and said second terminal receiving an AC power supply network, a voltage doubler for charging a storage capacitor (7), said voltage doubler comprising, in series form the first terminal (1), a first capacitor (5), a first resistor (4), a first diode (6) and a second resistor (8), and in parallel between the second terminal (2) and a point common to both the first resistor (4) and the first diode (6), a second diode (3), the storage capacitor (7) being capable of abrupt discharge into a primary of a transformer (10), a secondary of said transformer supplying a fence through a first thyristor (9), a triggering circuit (23) controlling a gate of said first thyristor, the triggering circuit (23) including an input (27) connected to the common point of the first resistor (4) and the first and second diodes (3, 6), a triggering of a conductive state in the first thyristor (9) occurring when the first terminal (1) is near a most negative potential in relation to a potential of the second terminal (2), so as not to disturb the network with a disturb signal.

2. The electrifying device as claimed in claim 1, wherein the triggering circuit (23) of the first thyristor (9) comprises a transistor (28) having a collector connected to the gate of the first thyristor (9), the transistor (28) having an emitter connected to a mid-point of a circuit with a third resistor (13) and a second capacitor (14), the transistor (28) having a base connected to said input (27), and said transistor (28) being made conductive when the first terminal (1) is near the most negative potential in relation to the potential of the second terminal (2).

3. The electrifying device as claimed in claim 2, wherein the first thyristor (9) gate is connected to the transistor (28) collector via a bidirectional diode thyristor (11) and a fourth resistor (12).

4. The electrifying device as claimed in claim 2, wherein the transistor (28) base is connected to said input (27) of the triggering circuit (23) via a Zener diode (30), resistor (29), and a third diode (31).

5. The electrifying device as claimed in claim 2, wherein the circuit with the third resistor (13) and the second capacitor (14) is mounted between the first terminal (1) and the second terminal (2).

6. The electrifying device as claimed in claim 5, further comprising a fourth diode (32), between the first terminal (1) and the third resistor (13), to charge the second capacitor (14) during positive swings of the power supply network.

7. The electrifying device as claimed in claim 2, wherein the circuit with the third resistor (13) and the second capacitor (14) is mounted between the primary of the transformer and the second terminal (2).

* * * * *